United States Patent [19]

Baugh

[11] Patent Number: 4,827,745

[45] Date of Patent: May 9, 1989

[54] LOCKSET SECURITY DEVICE

[76] Inventor: Benton F. Baugh, 14626 Oak Bend, Houston, Tex. 77079

[21] Appl. No.: 138,432

[22] Filed: Dec. 28, 1987

[51] Int. Cl.[4] ..... E05B 13/00

[52] U.S. Cl. ..... 70/416 L; 70/211

[58] Field of Search ..... 70/416, 429, 430, 209, 70/210, 211

[56] References Cited

U.S. PATENT DOCUMENTS

| | | | |
|---|---|---|---|
| 2,463,195 | 3/1949 | Mungan | 70/416 |
| 3,263,462 | 8/1966 | Suroff | 70/416 |
| 3,826,117 | 7/1974 | Racobs | 70/416 |
| 3,933,014 | 1/1976 | Moses | 70/416 |

*Primary Examiner*—Robert L. Wolfe

[57] ABSTRACT

A device which enhances the security of cylinder type locking devices by mechanically preventing the rotary unlocking motion even after keys or other security devices or methods have been activated and the locking device would otherwise be released.

2 Claims, 2 Drawing Sheets

LOCKSET SECURITY DEVICE

FIELD OF THE INVENTION

The field of invention of this device is that of lock and security devices, and more particularly of devices to enhance the security of locksets with keyed locking mechanisms.

BACKGROUND OF THE INVENTION

Conventional deadbolt locks manufactured today are generally of a "Yale" type which have been in active use since their invention in 1865 by Linus Yale. They are well illustrated under the category of "Locks" in typical encyclopedias, such as page 368 of Volume "L" of the 1973 Revision of the World Book Encyclopedia. The basic construction is of a cylinder with a central plug. Several, usually 4 or 5, holes are drilled thru the cylinder into the central plug along a common plane. Driver pins, locking pins, and springs are placed in the holes and retained. The interface between the driver pins and the locking pins are positioned within the central plug. The position therefore of the locking pins in the holes bridging the cylinder and the central plug prevents the central plug from being rotated. This rotation of the central plug is the movement which normally provides the unlocking motion of the locksets.

There is typically a special profile slot along the centerline of the plug to receive an appropriately designed key. The insertion of an appropriately designed key with a specifically ground key profile into the key slot raises each of the driver pins and therefore the locking pins to a point such that the interface between the driver pins and the locking pins is at the cylindrical gap between the cylinder and the central plug. This allows the central plug to be rotated, causing the lock to be "unlocked".

The ability to require 4 or 5 driver pin/locking pin combinations to be at precisely the same height before the central plug can be rotated has historically provided a relatively high degree of security against the lock being opened without a proper key.

In the intervening years since the invention of the Yale lock, other devices have been developed to thwart the security of this type device. Lock picking tools are manufactured and sold to allow a person to unlock a Yale lock without a key. Using these tools, typicaly a slight rotary spring tension is applied by a spring bar to tend to rotate the central plug toward the unlocking direction. A thin pick is then used to individually lift the pins until the interface between the driver pin and the locking pin "catches" at the interface between the central plug and the cylinder. This catching actions is facilitated by microscopic manufacturing differences in the diameters of the individual holes and the diameters of the individual pins. When all of the locking pins are caught at the interface, the spring tension starts the unlocking motion.

In some cases, a pick can be moved swiftly along the key hole and can quickly unlock the lock. This cannot be done on all locks, but when it works, a lock can be unlocked in less than one second. Further, a Lock Gun is sold which looks somewhat like a small pistol. It is inserted into the lock and a trigger pulled. The impact of a bar against the driver pins in combination with the spring tension as mentioned above can in some cases quickly release a lock.

The net effect of these and other devices is that high security locks such as deadbolt locks can be easily and quickly be defeated by persons with small and available tooling.

SUMMARY OF THE INVENTION

The object of the present invention is to provide a device which will provide complete security to a Yale locking device and prevent the lock from being picked. This is achieved by engaging a personality on the opposite side of the door from the keyed side which is required to turn with the keyed lock and prevent its rotation. This will prevent the lock from being unlocked, even with the proper key.

DESCRIPTION OF THE PREFERRED EMBODIMENT

Figure 1:
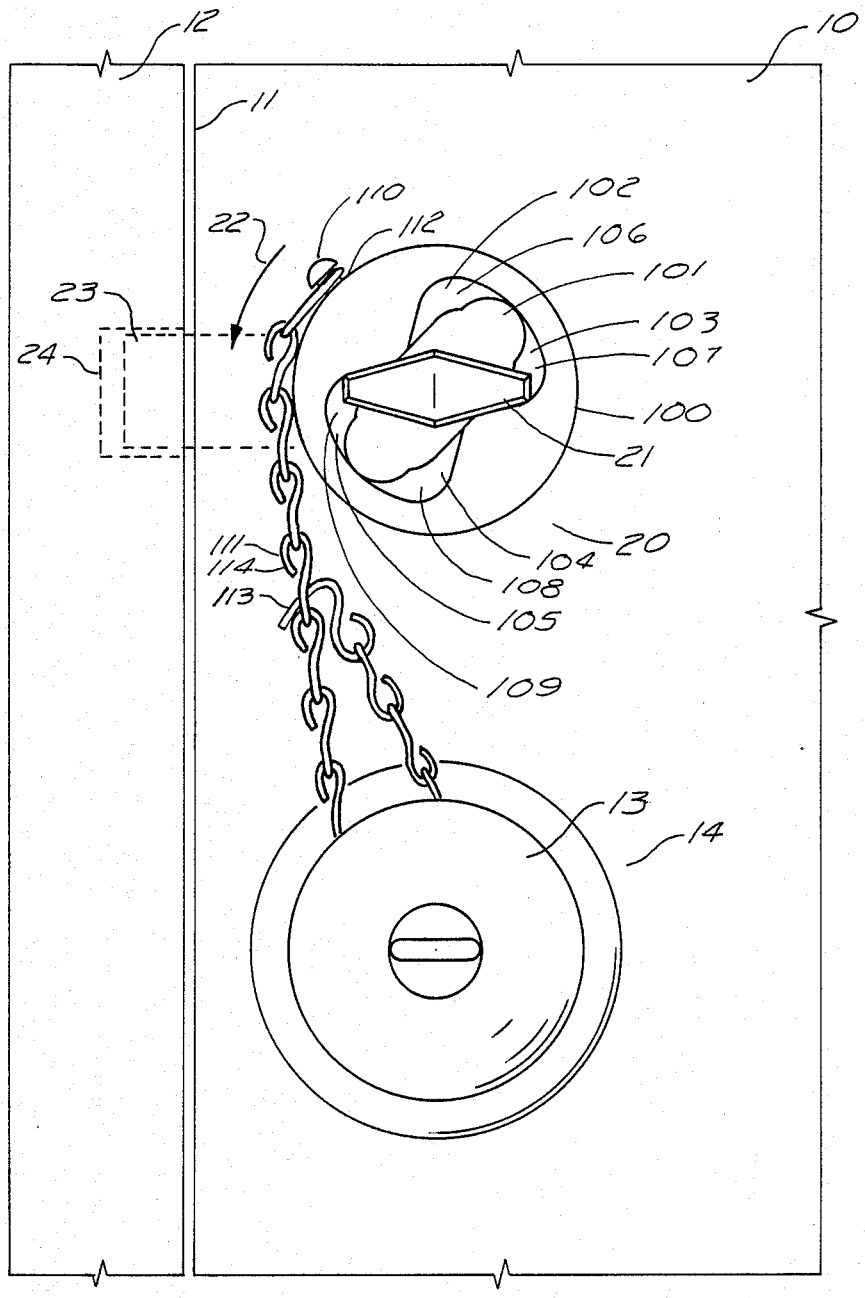
FIG. 1 is a view of the device installed on the side of the door opposite to the side which will receive the key for unlocking.

Referring now to FIG. 1, a door 10 is shown with a door edge 11 and a door jam 12. A typical door knob 13 is shown as a part of a conventional door lockset 14. The term lockset is generally taken to mean all the hardware associated with the mounting and operating of doorknobs, with or without keyed locking mechanisms. Keyed locking mechanisms is taken to mean devices which are designed to be operated by specially coded keys. This coding is usually physical steps ground into the key. In some cases it can be magnetic or electronic.

The side of the door 10 shown is the interior, with the exterior part of the lockset 14 having a keyed locking mechanism as was previously described (not shown). A few inches above the lockset 14 is a lockset generally referred to as a deadbolt lockset 20 with a handle 21 mounted on the interior side of the door 10. The exterior part of the deadbolt lockset 20 provides a keyed locking mechanism. The interior and exterior designations for sides of a door are for convenience of explanation only. Both sides of the door may be within or outside of a building in some cases.

The arrow 22 illustrates the direction of rotation which must be imparted to the handle 21 to cause the deadbolt lockset to be moved from the unlocked position to the locked position. In like manner, if the handle 21 is rotated oppositely to the arrow 22, the mechanism will be moved from the locked position to the unlocked position.

Locked in this context means that a locking bolt 23 in the door 10 is moved into a receptacle 24 in the door jam 12. Unlocked is taken to mean that the mechanism within the deadbolt lockset 20 moves that locking bolt 23 from the receptable 24 to a position completely within the door 10.

Figure 2:
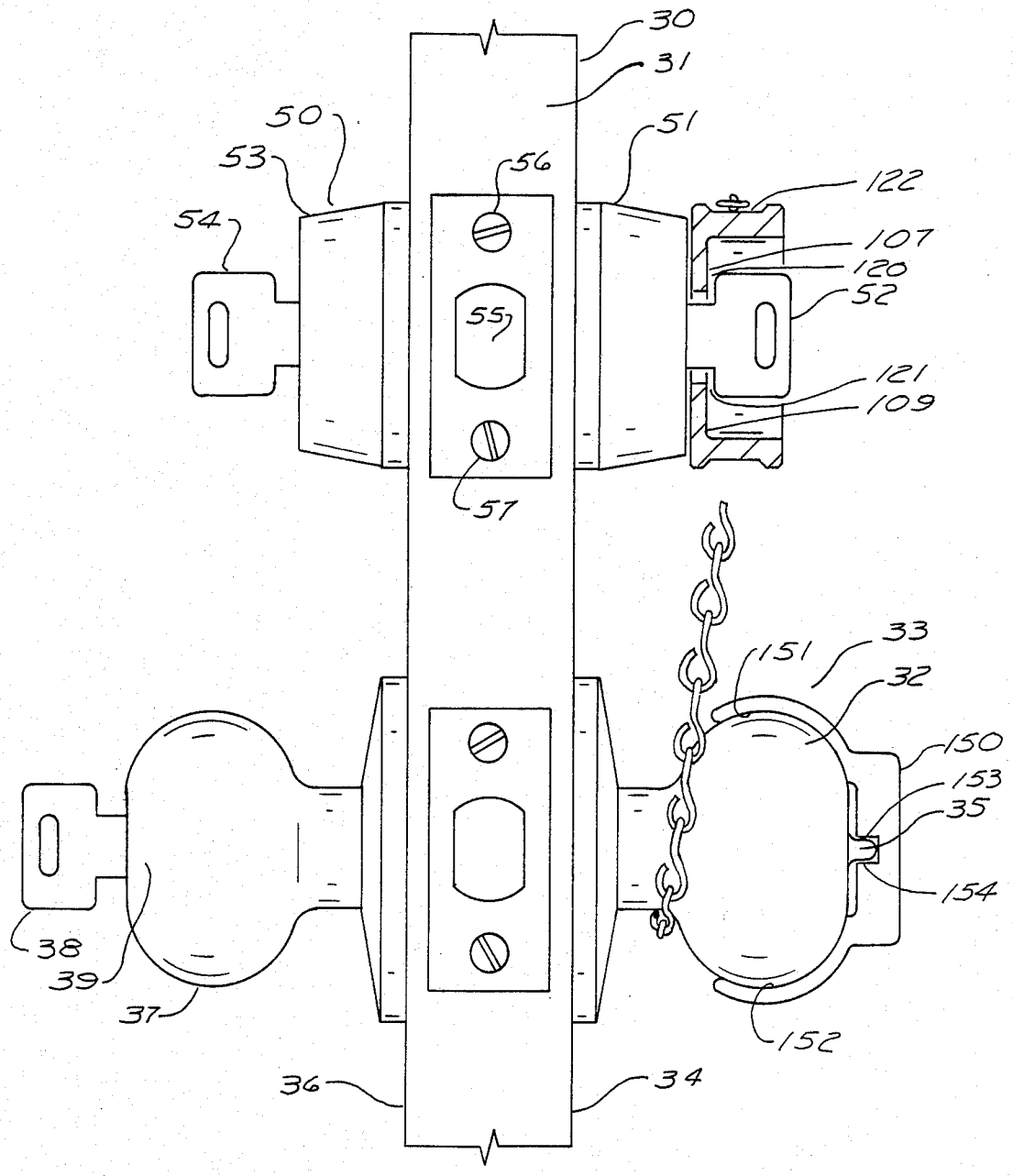
FIG. 2 is a view of the edge of a door with the devices of this invention installed.

Referring now to FIG. 2, a door 30 is shown as if fully opened and looking at the edge 31 of the door 30. A typical door knob 32 is shown as a part of a conventional door lockset 33 on the interior side 34 of the door 30. The door knob 32 has a small finger turned knob 35 for locking and unlocking the lockset, as is well known in the art. The exterior side 36 of the door 30 has a door knob 37 with a key 38 inserted in a typical keyed locking mechanism 39 (not shown).

A few inches above the lockset 33 is a deadbolt lockset 50 with a keyed locking mechanism 51 on the interior side 34 of the door 30. Key 52 is installed in keyed locking mechanism 51. A keyed locking mechanism 53 is installed on the exterior side of the door 30 and has a key 54 installed. Locking bolt 55 is shown on the edge 31 of the door 30 along with screws 56 and 57 which secure the portion of the lockset to the edge of the door.

Referring again to FIG. 1, ring 100 has a oblong cut out area 101 extending thru the ring and cut out areas 102, 103, 104, and 105 which extend part way thru the ring 100. The cut out areas, 102, 103, 104, and 105 on ring 100 result in shoulders 106, 107, 108, and 109.

The cut out area 101 is designed to be larger than the typical handle 21 or key 52 such that it will pass over such handle or key. Once the ring 100 is installed over such handle or key, it can be rotated clockwise or counterclockwise and shoulders 106 and 108 or 107 and 109 will interlock with such handle or key to assist in securing ring 100 to such handle or key.

A screw 110 or similar device is inserted thru the end of a chain 111 and into the perimeter 112 of the ring 100. This allows the chain 111 to be wrapped around the perimeter 112 of the ring 100 in either the clockwise or counterclockwise direction. In operation, the ring 100 will be installed over the knob 21 or key 52 and rotated in the same direction as was the locking direction of the of the device. The chain 111 will be wrapped around the perimeter 112 of the ring 100 in that same direction. The amount of the wrapping can be from only a portion of a turn up to several turns depending on other considerations to be discussed below.

The chain 111 is then taken down to any other object on the door such as the knob 13, wrapped around the knob, and then the hook 113 is engaged into one of the links 114 of the chain 111. Depending on the spacing between the lockset 20 and the lockset 14, the chain 111 may be wrapped one or more times around the ring 100 or the knob 13.

When keys are utilized on the exterior side of locksets such as 20, these keyed locking mechanisms require that the handle 21 be rotated opposite to their locking direction to be able to rotate the key. By preventing the rotation of the handle 21, the keyed locking mechanism on the opposite side of the door is absolutely prevented from being operated.

Referring again to FIG. 2, the ring 100 is shown engaged over the key 52 and the shoulders 107 and 109 are shown engaging the spaces 120 and 121. This engagement of the shoulders 107 and 109 in the spaces 120 and 121 keeps the ring 100 on the key 52. Groove 122 is cut into the outer diameter of ring 100 to assist in the chain's 111 staying in place when being wrapped around the ring 100.

A key such as 52 when left in a keyed locking mechanism 51 such as this is typically rotated in a first direction to lock the keyed locking device and then rotated part way back in the opposite direction to a position for removal, even when not removed. This partial rotation in the reversed direction makes it appear that the keyed locking mechanism 51 does not have to be rotated to allow the operation of keyed locking mechanism 53. The rotation is required, it is just that the person has already done it. Use of a lockset security device such as those of this invention causes the key 52 to be rotated to be fully locked orientation, and held at that position. In this way the device of this invention will work equally well on keys of keyed locking mechanisms as well as handles on keyed locking mechanisms.

Another embodiment of this invention is shown on FIG. 2 as clip 150. Clip 150 is a device for with surfaces 151 and 152 for engaging the outer surfaces of the door knob 32 and surfaces 153 and 154 for engaging the surfaces of small finger turned knob 35. The friction caused by the engagement of surfaces 151 and 152 on the outer surfaces of door knob 32 prevent the clip 150 from being readily rotated and in turn prevents the small finger turned knob 35 from being readily rotated. This frictional resistance to rotation is imparted to the keyed locking mechanism 39 and thereby prevents the key 38 from being able to unlock the lockset.

The foregoing disclosure and description of this invention are illustrative and explanatory thereof, and various changes in the size, shape, and materials, as well as the details of the illustrated construction may be made without departing from the spirit of the invention.

I claim:

1. In a lockset device with a locking mechanism for use with a key for causing a door to be secured against being opened from a first side without said key means, a projection on said lockset on a second side of said door, said projection being rotated in a first direction to cause a locking action between said door and a door jam means, and being rotated in a second direction to cause an unlocking action, a first member to be fitted over said projection, a flexible member attached to said first member, said flexible member engaging a second member on said door, such attachment of said flexible member to said first member and said engaging of said flexible member to said second member cooperating to prevent said projection on said lockset from moving in said second direction to cause said unlocking action, such that when said key or other devices are used to try to unlock said locking mechanism and therefore said lockset device, such unlocking is prevented, wherein said flexible member is a chain.

2. In a lockset device with a locking mechanism for use with a key for causing a door to be secured against being opened from a first side without said key means, a projection on said lockset on a second side of said door, said projection being rotated in a first direction to cause a locking action between said door and a door jam means, and being rotated in a second direction to cause an unlocking action, a first member to be fitted over said projection, a flexible member attached to said first member, said flexible member engaging a second member on said door, such attachment of said flexible member to said first member and said engaging of said flexible member to said second member cooperating to prevent said projection on said lockset from moving in said second direction to cause said unlocking action, such that when said key or other devices are used to try to unlock said locking mechanism and therefore said lockset device, such unlocking is prevented, wherein said flexible member is a chain having a hook means on its end and said second member is a knob type projection from a second lockset on said door such that said chain is wrapped around said first member in the direction of the locking rotation, is wrapped around said knob type projection, and is hooked back into one of the chain's links between the first member and the knob type projection.

* * * * *